US007891422B2

(12) United States Patent
Maclean

(10) Patent No.: US 7,891,422 B2
(45) Date of Patent: Feb. 22, 2011

(54) SENSING TOOL

(75) Inventor: Iain M. Maclean, Aberdeen (GB)

(73) Assignee: Baker Hughes Incorporated, Houston, TX (US)

( * ) Notice: Subject to any disclaimer, the term of this patent is extended or adjusted under 35 U.S.C. 154(b) by 126 days.

(21) Appl. No.: 11/960,044

(22) Filed: Dec. 19, 2007

(65) Prior Publication Data

US 2008/0277573 A1 Nov. 13, 2008

Related U.S. Application Data

(60) Provisional application No. 60/877,592, filed on Dec. 28, 2006.

(51) Int. Cl.
*E21B 47/10* (2006.01)

(52) U.S. Cl. ..... 166/250.01; 166/66; 73/152.31; 73/152.29

(58) Field of Classification Search ..... 166/250.01, 166/66, 241.5; 73/152.29–152.31, 152.52, 73/152.2

See application file for complete search history.

(56) References Cited

U.S. PATENT DOCUMENTS

| | | | | |
|---|---|---|---|---|
| 3,175,399 | A * | 3/1965 | Medlar | 73/861.21 |
| 4,619,322 | A * | 10/1986 | Armell et al. | 166/241.5 |
| 4,673,890 | A * | 6/1987 | Copland et al. | 33/544.2 |
| 4,715,440 | A * | 12/1987 | Boxell et al. | 166/100 |
| 4,790,381 | A * | 12/1988 | Armell | 166/241.5 |
| 5,574,263 | A * | 11/1996 | Roesner | 181/102 |
| 5,727,628 | A * | 3/1998 | Patzner | 166/249 |
| 6,581,454 | B1 | 6/2003 | Smith | |
| 6,622,803 | B2 * | 9/2003 | Harvey et al. | 175/325.3 |
| 7,114,386 | B1 * | 10/2006 | Veignat et al. | 73/152.29 |
| 2003/0145984 | A1 * | 8/2003 | Webre et al. | 166/64 |
| 2007/0242265 | A1 * | 10/2007 | Vessereau et al. | 356/241.1 |

FOREIGN PATENT DOCUMENTS

| | | | |
|---|---|---|---|
| GB | 2294074 | A | 4/1996 |
| WO | 2004025078 | A | 3/2004 |

OTHER PUBLICATIONS

Halliburton, "Reservoir Monitoring and Completion Solutions", Reservoir Performance, www.halliburton.com, 2005, pp. 1-6.

Tim Brewer, Tatsuki Endo, Masahirokamata, Paul Jeffrey Fox, Dave Golberg, Greg Myers, Yoshi Kawamura, Shinichi Kuramoto, Steve Kittredge, Stefan Mrozewski, Frank R. Rack, Scientific Deep-Ocean Drilling: Revealing the Earth's Secrets, Oilfield review, winter 2004/2005, pp. 24-37.

Alan Baker, John Gaskell, John Heffrey, Alan Thomas, Toney Veneruso, Trond Unneland, "Permanent Monitoring-Looking at Lifetime Reservoir Dynamics", Oilfield revew, winter 1995, pp. 32-46.

PCT Search Report and Written Opinion; Application No. PCT/US2007/088265, Mailed Jul. 16, 2008, Search Report Having 5 Pages and Written Opinion having 8 Pages.

* cited by examiner

*Primary Examiner*—William P Neuder
*Assistant Examiner*—Kipp C Wallace
(74) *Attorney, Agent, or Firm*—Cantor Colburn LLP

(57) ABSTRACT

A sensor system includes a carrier configured for a specific application; an electronics module mountable in a number of individual carriers; a feedthrough mountable in a number of individual carriers and in operable communication with the interface; a sensor mounting mountable in a number of individual carriers and in operable communication with the feedthrough; and a sensor array articulated to the sensor mounting.

15 Claims, 1 Drawing Sheet

SENSING TOOL

CROSS REFERENCE TO RELATED APPLICATIONS

This application claims priority to Provisional Application No. 60/877,592 filed Dec. 28, 2006, the entire contents of which are incorporated herein by reference.

BACKGROUND OF THE INVENTION

In the hydrocarbon exploration and recovery industry, fluid identification testing in the downhole environment is an important part of well operation. Such testing, for example water fraction, fluid density, etc., is most effectively conducted with a sensor or sensor array disposed within the fluid flow. This is because flows are often not homogenous. Testing therefore has been accomplished by devices that are either fixedly installed directly within the flow to be measured or are temporarily run in the hole on, for example, a wireline. While effective monitoring has been carried out in many a well in this manner, there are drawbacks. Positioning sensors or sensor arrays within the flow is contraindicated in cases where restriction of the flow channel is undesirable. This is commonly the case in the hydrocarbon industry because the rate of production of hydrocarbons is fantastically important to the economic bottom line of a company and the ability to run tools in the well directly contributes to productivity and is itself restricted by the presence of a sensor array that occludes the flow channel. Further, existing fluid identification tools are specific to tubing or casing string sizes, are large in size, require extensive design work for different well completion options, are difficult to test, are expensive and can require significant rig time in the event of any complications.

In view of the foregoing, the art would certainly welcome a solution that provides for monitoring of well fluid identification without the drawbacks noted.

SUMMARY

A sensor system includes a carrier configured for a specific application; a signal interface mountable in a number of individual carriers; a feedthrough mountable in a number of individual carriers and in operable communication with the interface; a sensor mounting mountable in a number of individual carriers and in operable communication with the feedthrough; and a sensor array articulated to the sensor mounting.

A method of sensing fluid identity in a wellbore while allowing for separate tool runs includes running a separate tool into the wellbore; contacting a sensor array disposed within a fluid flow pathway of the wellbore with the separate tool; urging the array away from a rest position with the separate tool out of a path of the separate tool; and biasing the sensor array back into the flow path when the tool is clear of the array.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

Figure 1:
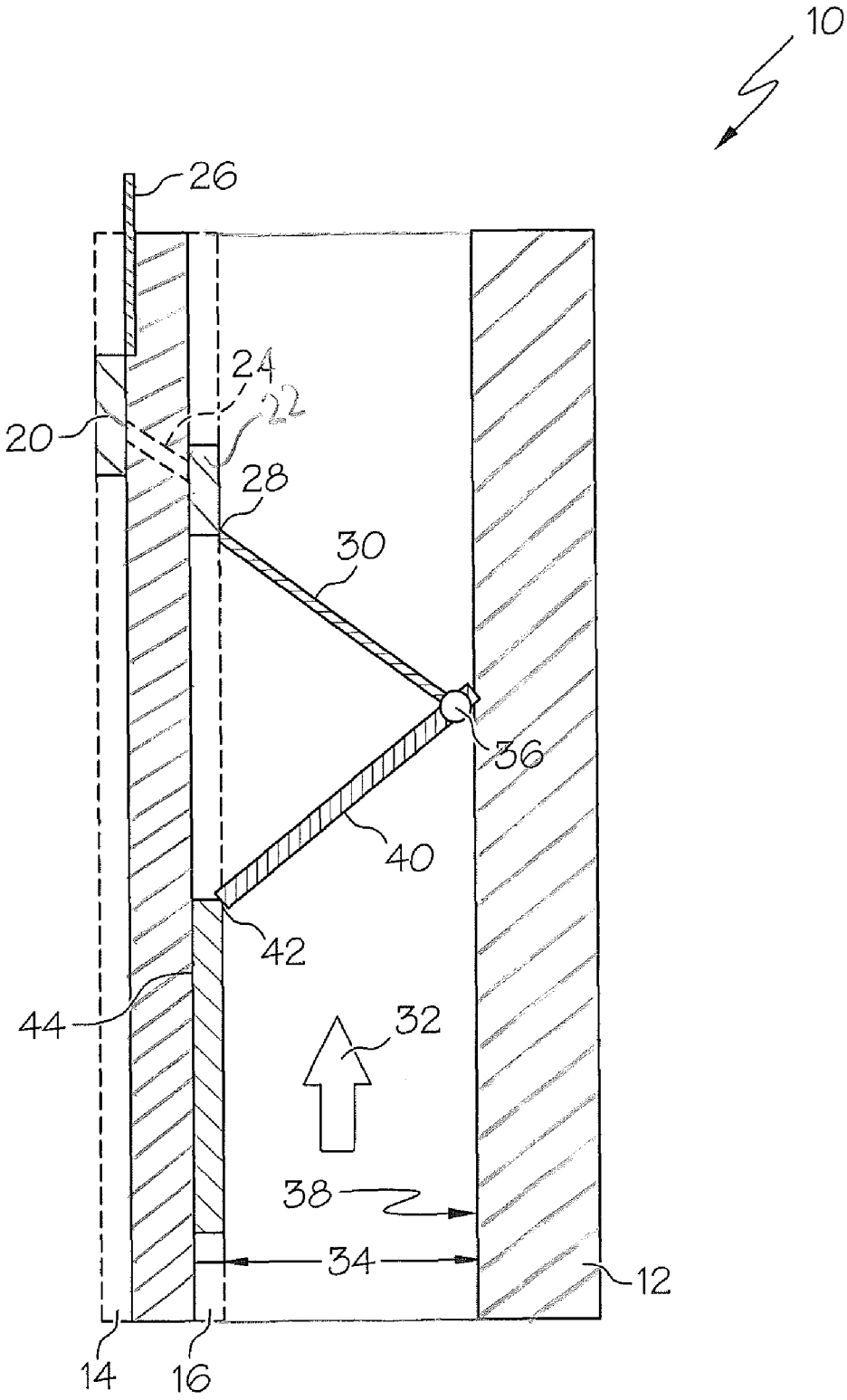
FIG. 1 is a schematic cross-sectional elevation view of a sensing tool.

Referring to FIG. 1, a sensing tool 10 is illustrated in cross-section. The tool 10 includes a tubular carrier 12 that serves as a housing for all other components of the tool 10 and further comprises ends (not shown) suitably configured to attach the tool 10 to a tubing or casing string (not shown). In one embodiment, the ends would comprise standard box or pin threads to connect into a tubing or casing string without any other special preparation.

Carrier 12 is manufacturable in a multitude of lengths, diameters, etc. in order to fit a particular application and does not represent significant cost. This is because carrier 12 is simply a "dumb" component. That is to say that carrier 12 does not include electrical or computer components as part of itself but rather merely provides a mounting frame for such components. The carrier may be constructed of metal, plastic, ceramic or any other material deemed structurally sufficient for the task.

As illustrated in FIG. 1, recesses 14 and 16 are created in the carrier by means of for example, machining, molding in, etc. Recesses 14 and 16 are of a size and shape to accommodate the functional components of the tool 10. In general, every tool 10 will include a signal interface 20 such as an electronics module or an optical coupler, combination of these, etc., a sensor mounting 22 and a feed through 24 (electrical, optical, combination of these, etc.) operably connecting the interface 20 to the mounting 22. The feedthrough 24 in one embodiment comprises an electrical feedthrough with high-pressure barrier while in another embodiment, feedthrough 24 comprises an inductive coupler. Such feedthrough methods are commercially available, are familiar to those of skill in the art and do not require particular explanation here. Other means for providing feedthrough operable communication are also contemplated and require either a pressure barrier or a system (module, etc.) that is exposable to wellbore fluids and pressure. Further, interface 20 includes a cable 26 running to a remote location, which may be a surface location, the cable being capable of propagating a signal. The signal is at least one of light energy, electrical energy or acoustic energy and may be carried in a medium of an optic fiber, electrical conductor or hydraulic tube as the cable. It is further to be appreciated that the signal may be informational or a power signal or both.

It is to be appreciated that the interface 20, sensor mounting 22, and feedthrough are intended to be the same for a large number of sizes of tools. It may be that a single set of interface and sensor mounting are generic to all carriers 12 although it is to be understood that alternatively, a few sizes and shapes of interface 20 and sensor mounting 22 could be manufactured to support a large number of carriers of different sizes, economies still being reaped over conventional custom made configurations.

The sensor mounting 22, in one embodiment, carries sensors itself while in other embodiments such as shown in FIG. 1, the sensor(s) is/are supported at the sensor mounting electrically, optically, chemically, etc. in addition to mechanically. In the embodiment shown in FIG. 1, the sensor mounting 22 includes an articulated connection 28, which may be a hinge that articulatingly supports a sensor array 30. The array 30 as illustrated is disposed directly within the flow path 32 defined by the inside dimension 34 of the carrier 12. The sensor array 30, in one embodiment, and as illustrated extends diametrically all the way across dimension 34 and so is provided with a low friction interface 36, which may be a roller (e.g. metal, Polytetrafluoroethylene, Polyetheretherketone, plastic, etc), bushing (e.g. metal, Polytetrafluoroethylene, Polyetheretherketone, plastic, etc), coating, sleeve, etc., to contact an inside surface 38 of carrier 12. Further connected to the interface 36 is a support 40 that itself is articulatingly connected at a connection 42, which may be a hinge to a biasing arrangement 44. It is important to note as well that interface 36 is articulated within itself, at sensor array 30, at support 40 or at a combination of these. Biasing arrangement 44 may be a spring, a gas cylinder, an elastomeric element, etc. providing it is capable of supplying a return force when compressed. The arrangement resides within recess 16 and operates to urge connection 42 toward connection 28. Movement of connection 42 toward 28 causes interface 36 to be urged to contact surface 38 at a point diametrically opposed to a location of the sensor mounting 22. In this position, the sensor array 30 is optimally positioned to sense whatever parameter of the fluid it is designed to sense. At the same time, because the arrangement 44 is a biasing arrangement and not a fixed one, a tool run through the carrier 12 from uphole (top of drawing) is easily able to push the sensor array 30 out of its way by overcoming the biasing force available from the biasing arrangement 44, compressing the same and causing connection 42 to become more linearly spaced from connection 28. Upon withdrawal of the tool, the sensor array 30 is automatically moved back into its optimum position. Hereby, sensors intended to query fluid identification are automatically maintained in a position highly appropriate to achieve the desired end while simultaneously providing a "full bore" patency for pass through of other tools.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A sensor system configured for permanent installation downhole as a part of a tubing or casing string comprising:

a carrier configured for a specific application and to be made up as a part of the tubing or casing string;

a signal interface mountable in a number of individual carriers and exposed to an external surface of the tubing or casing string;

a feedthrough mountable in a number of individual carriers and in operable communication with the interface, the feedthrough providing signal communication through an inside diameter surface of a wall of the carrier and maintaining a pressure barrier between fluid within the tubing or casing string and fluid pressure outside of the tubing or casing string;

a sensor mounting mountable in a number of individual carriers and in operable communication with the feedthrough to position the sensor mounting within a flow portion of the carrier; and a sensor array articulated to the sensor mounting so that the sensor is positioned within a flow through the tubing string, in use.

2. The sensor system as claimed in claim 1 wherein the system further comprises a low friction interface at an end of the sensor array.

3. The sensor system as claimed in claim 1 wherein the low friction interface is spaced from an end of the sensor array.

4. The sensor system as claimed in claim 1 wherein the low friction interface is articulated to the sensor mounting.

5. The sensor system as claimed in claim 2 wherein the system further comprising a support having two ends, one of the two ends being articulated to the low friction interface.

6. The sensor system as claimed in claim 5 wherein the second of the two ends of the support is articulated to a biasing member.

7. The sensor system as claimed in claim 2 wherein the low friction interface is a roller.

8. The sensor system as claimed in claim 2 wherein the low friction interface is a coating.

9. The sensor system as claimed in claim 2 wherein the low friction interface is a sleeve.

10. The sensor system as claimed in claim 6 wherein the biasing member is an elastomeric element.

11. The sensor system as claimed in claim 6 wherein the biasing member is a gas cylinder.

12. The sensor system as claimed in claim 6 wherein the biasing member is a spring.

13. The sensor system as claimed in claim 1 wherein the signal interface is an electrical module.

14. The sensor system as claimed in claim 1 wherein the signal interface is an optical coupling.

15. The sensor system as claimed in claim 1 wherein the signal interface is a combination of an electrical module and an optical coupling.

* * * * *